United States Patent [19]

Honkura et al.

[11] Patent Number: 4,957,699

[45] Date of Patent: Sep. 18, 1990

[54] SOFT MAGNETIC CR-AL STEEL

[75] Inventors: Yoshinobu Honkura; Hideki Fujii; Koji Murata, all of Aichi, Japan

[73] Assignee: Aichi Steel Works Ltd., Aichi, Japan

[21] Appl. No.: 217,001

[22] PCT Filed: Jan. 29, 1988

[86] PCT No.: PCT/JP88/00084

§ 371 Date: Apr. 28, 1989

§ 102(e) Date: Apr. 28, 1989

[87] PCT Pub. No.: WO89/00210

PCT Pub. Date: Jan. 12, 1989

[30] Foreign Application Priority Data

Jun. 30, 1987 [JP] Japan ..... 62-162929

[51] Int. Cl.[5] ..... C22C 38/06; C22C 38/18

[52] U.S. Cl. ..... 420/41; 420/103; 420/62; 420/84; 148/306; 148/309

[58] Field of Search ..... 148/306, 309; 420/62, 420/84, 41, 103

[56] References Cited

U.S. PATENT DOCUMENTS 1,710,805 4/1929 Smith et al. ..... 148/306

FOREIGN PATENT DOCUMENTS 39816 1/1964 Japan .
52-63813 5/1977 Japan .
53-19914 2/1978 Japan .
55-118333 9/1980 Japan ..... 420/62
55-152158 11/1980 Japan .
56-65965 6/1981 Japan ..... 420/62
57-192246 11/1982 Japan ..... 148/306

*Primary Examiner*—Deborah Yee
*Attorney, Agent, or Firm*—Sughrue, Mion, Zinn, Macpeak & Seas

[57] ABSTRACT

The present invention relates to a soft magnetic steel improved in electric resistance, coercive force, magnetic flux density, magnetic response, cold forgeability, machinability, and corrosion resistance, which is characterized by the composition containing by weight, 0.015% or lower C+N, 0.20% or lower Si, 0.20% or lower Mn, 7 to 13% Cr, 2 to 5% Al, and balance of Fe with impurities, which is applicable to core materials of electronic fuel injection systems, solenoid valves, electromagnetic sensors, etc.

4 Claims, 1 Drawing Sheet

SOFT MAGNETIC CR-AL STEEL

FIELD OF THE INVENTION

The present invention relates to a soft magnetic steel suitable for magnetic core materials for electronic fuel injection systems, solenoid valves, electromagnetic sensors, etc., improved in electric properties, magnetic properties such as coercive force, magnetic flux density, and magnetic response, cold forgeability, machinability, and corrosion resistance.

BACKGROUND OF THE INVENTION

High electric resistance for improved magnetic response and improved pulse response to increase pulse frequency are demanded for the magnetic core materials for the recently developed electronic fuel injection systems, solenoid valves, electromagnetic sensors, etc. Further, corrosion resistance to improve environmental adaptability, an excellent cold forgeability and machinability for cost reduction, are also required.

Pure iron, 3Si-iron, 13Cr-2.5Si steel, and 13Cr-1Si-0.25Al steel are currently used for the core materials of the above-mentioned applications.

Pure iron has excellent cold forgeability, however, is poor in electric resistance, magnetic properties and response, and coercive force. 3%Si-iron has an electric resistance of 60μΩ•cm, which is not sufficient, and as the same as in the case of pure iron, is poor in magnetic response and coercive force in addition to corrosion resistance and cold forgeability.

13Cr-2.5Si steel shows excellent electric resistance and corrosion resistance, however, is inferior in magnetic properties, cold forgeability, and machinability. 13Cr-1Si-0.25Al steel excels in corrosion resistance and machinability, but on the other hand, does not have satisfactory electric resistance, magnetic response, coercive force, magnetic flux density, and cold forgeability.

As above mentioned, no currently available steel suffices in all the electric properties (electric resistance), magnetic properties such as magnetic response, coercive force, and magnetic flux density, cold forgeability, machinability, and corrosion resistance.

DISCLOSURE OF THE INVENTION

The invention, as a solution to the aforesaid problems of the conventional steels used as the core materials for electronic fuel injection systems, solenoid valves, electromagnetic sensors, etc., possess characteristics essential to the aforesaid core materials, which are electric resistance of 90 μΩ•cm or higher, excellent magnetic properties such as a coercive force of 0.7 Oe or lower, magnetic flux density of 13000 G or higher, and magnetic response with relaxation time of 0.7 msec or shorter, together with improved cold forgeability with a tensile strength of 44 KgF/ $mm^2$ or lower, and with increased corrosion resistance and machinability.

The inventors, with a view to overcoming the above mentioned problems of the conventional steels, have carried out concentrated studies on the effects of the each alloy element on the electric properties, magnetic properties such as magnetic response, coercive force, and magnetic flux density, corrosion resistance, and cold forgeability, and finally achieved the completion of the invention.

First, electric resistance and tensile strength are conflicting properties. When an amount of Si was increased to raise the electric resistance, the tensile strength also increased, leading to poor cold forgeability. This is clearly read in FIG. 1, wherein the tensile strength is related to the electric resistance of the Fe-Si system steel. It is illustrated in the Fe-Cr-Al system that at the addition of 7 to 13% Cr together with 2 to 5% Al, electric resistance, force are improved without significant raise in tensile strength.

Secondly, the addition of 7 to 13% Cr together with 2 to 5% Al noticeably increased the corrosion resistance, which was unpredictable from individual additions.

Thirdly, it was also without affecting of CR and al on the cold forgeability, the contents of the solid-solution strengthening elements such as C, N, Si, and Mn and impurities such as Cu, Ni, and Mo should be as reduced as much as possible. It was then found that when the impurity level was lowered to an unusual level compared with those of conventional steels and stainless steels, a soft magnetic steel with excellent electric resistance of 100 μΩ•cm or higher with improved cold forgeability with a tensile strength of about 42 $KgF/mm^2$ could be obtained.

The present invention is based on the above findings, and thus, by addition of 7 to 13% Cr together with 2 to 5% Al, electric resistance, magnetic properties such as magnetic response, coercive force, and magnetic flux density are improved without significant increase of tensile strength. In addition, cold forgeability is improved by controlling an amount of C+N to be not higher than 0.015%, Si to be 0.20% or lower, and Mn to be 0.20% or lower.

Further, Ti is added in an amount of not higher than 0.08% to improve the cold forgeability and corrosion resistance, whereas machinability is improved without affecting the cold forgeability by adding at least one ingredient selected from 0.050% or lower S, 0.050% or lower Se, and 0.30% or lower Pb, together with 0.20% or lower Zr and/or 0.030% or lower Te.

Thus, the present invention relates to a soft magnetic steel which possesses characteristics essential to the aforesaid core materials, which are an electric resistance of 90 μΩ•cm or higher, excellent magnetic properties such as a coercive force of 0.7 Oe or lower, magnetic flux density of 13000 G or higher, and magnetic response with relaxation time of 0.7 msec or shorter, together with improved cold forgeability with a tensile strength of 44 $KgF/mm^2$ or lower, critical compressibility of 60% or higher and with increased corrosion resistance and machinability.

That is, the first invention consists by weight of 0.015% or lower C+N, 0.20% or lower Si, 0.20% or lower Mn, 7 to 13% Cr, 2 to 5% Al, and Fe with impurities; the second invention is further improved in magnetic properties, corrosion resistance, and cold forgeability by adding 0.08% or lower Ti to the alloy steel of the first invention; the third invention is further improved in machinability without affecting the cold forgeability of the first invention, by adding at least one ingredient selected from 0.050% or lower S, 0.050% or lower Se, and 0.30% or lower Pb, together with 0.20% or lower Zr and/or 0.030% or lower Te to the alloy steel of the first invention; and the fourth invention is improved in machinability without affecting the cold forgeability of the second invention by adding at least one of of ingredient selected from 0.050% or lower S, 0.050% or lower Se, and 0.30% or lower Pb, together with 0.20% or lower Zr and/or 0.030% or lower Te to the alloy steel of the second invention.

The reason for limiting chemical compositions is explained in detail as set forth below.

Cr: 7 to 13%

Addition of Cr improves electric resistance, magnetic properties, and corrosion resistance; the effect is more remarkable when added together with 2 to 5% Al. When the addition is less than 7% Cr, insufficient effect is obtained in electric resistance, magnetic response, and corrosion resistance, therefore, the lower limit is set at 7%. When the addition exceeds 13%, however, magnetic response and cold forgeability are affected, therefore, the upper limit is set at 13%.

Al: 2 to 5%

Addition of Al as well as Cr which are main ingredients according to the present invention improves electric resistance, magnetic properties, and corrosion resistance, and especially is effective when added together with 7 to 13% Cr. When the addition is less than 2%, excellent magnetic properties cannot be achieved, therefore, the lower limit is set at 2%. When the addition exceeds 5%, on the other hand, magnetic properties and cold forgeability are damaged, therefore, the addition should be, in maximum, 5%.

C+N: 0.015% or lower

Magnetic properties, corrosion resistance, and cold forgeability are considerably spoiled by the addition of C and N. The total amount of C and N is preferably 0.010% or lower, however, taking the practical manufacturing into consideration, 0.015% or lower C+N was adopted. To minimize the harmful influences of the C and N, Ti should be preferably added for an amount 5 times as large as that of C+N.

Si: 0.20% or lower

Si in an usual steel making is an essential element for deoxidation, however, is not especially necessary in the case of an Fe-Cr-Al system, but noticeably degrades the magnetic properties and cold forgeability. Thus, the amount should be preferably controlled to 0.10% or lower. With a view to applying to the practical manufacturing, the concentration is limited to 0.20% or lower.

Mn: 0.20% or lower

The presence of Mn considerably degrades magnetic properties, corrosion resistance, and cold forgeability, accordingly, preferably concentration should be 0.10% or lower, however, from the practical point of view, it is limited to 0.20% or lower.

Ti: 0.08% or lower

Addition of Ti is effective in improving magnetic properties, corrosion resistance, and cold forgeability, and the maximum effect is displayed when added to an amount of 5 times as large as that of C+N. When added in a large amount, it adversely affects cold forgeability, and therefore, is limited to 0.08% or lower.

S: 0.050% or lower; Se: 0.050% or lower

S and Se are added to improve machinability. When added in too large an amount, the cold forgeability is affected, and, thus they are limited to 0.050% or lower.

Pb: 0.30% or lower

Addition of Pb improves machinability, but a large addition affects cold forgeability, therefore, Pb is limited to 0.30% or lower.

Te: 0.030% or lower

Addition of Te improves not only the machinability, but also cold forgeability by accelerating a spheroidization of S and Se inclusions. A large addition, however, creates poor effects on cold forgeability, and, therefore Te, is limited to 0.030% or lower.

Zr: 0.20% or lower

Addition of Zr improves cold forgeability by accelerating the spheroidization of S and Se inclusions. A large addition, however, adversely affects cold forgeability, and, thus, Zr is limited to 0.20% or lower.

PREFERRED EMBODIMENTS TO CARRY OUT THE INVENTION

Figure 1:
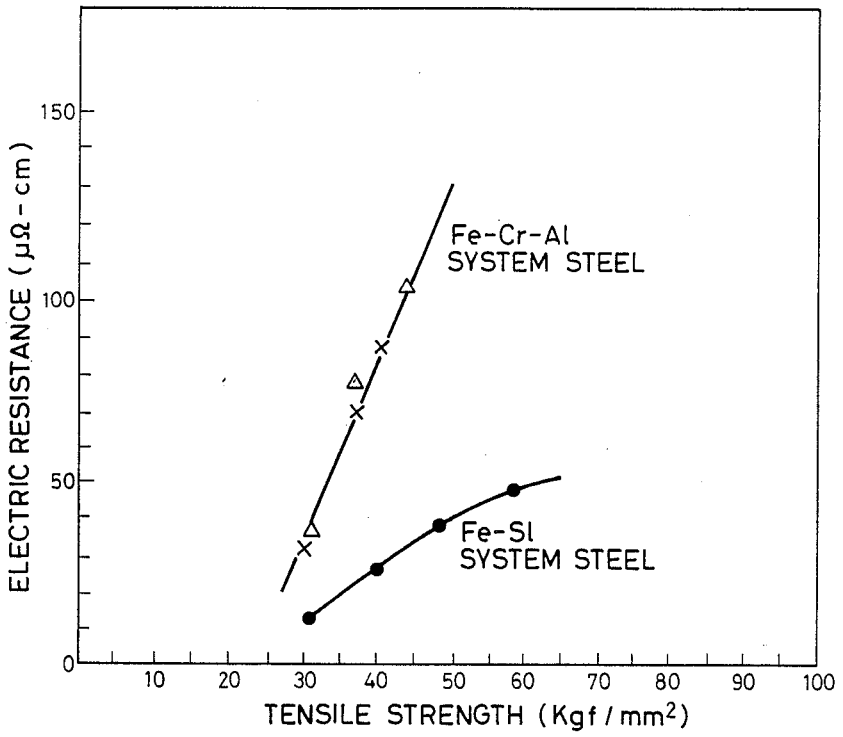
FIG. 1 is the diagram for Fe-Cr-Al system and Fe-Si system steels, relating an tensile strength with an electric resistance.

The characteristics of the soft magnetic steels of the present invention are shown in the following examples in comparison with conventional and comparative steels. Table 1 gives the chemical analysis of the specimens.

TABLE 1

| | | Chemical Composition (Weight %) | | | | | | | | | | |
|---|---|---|---|---|---|---|---|---|---|---|---|---|
| | No. | C + N | Si | Mn | Cr | Al | Ti | S | Se | Pb | Zr | Te |
| A | A1 | 0.008 | 0.12 | 0.08 | 8.21 | 4.70 | | | | | | |
| | A2 | 0.012 | 0.08 | 0.15 | 10.03 | 3.25 | | | | | | |
| | A3 | 0.010 | 0.14 | 0.10 | 11.85 | 2.72 | | | | | | |
| | A4 | 0.010 | 0.11 | 0.12 | 10.11 | 3.14 | 0.07 | | | | | |
| | A5 | 0.010 | 0.11 | 0.12 | 10.01 | 3.20 | | 0.022 | | | | 0.009 |
| | A6 | 0.010 | 0.12 | 0.12 | 10.04 | 3.18 | | | 0.035 | | 0.09 | |
| | A7 | 0.010 | 0.11 | 0.13 | 10.03 | 3.20 | | | | 0.21 | | 0.025 |
| | A8 | 0.010 | 0.13 | 0.12 | 10.04 | 3.18 | | 0.015 | | 0.17 | | 0.010 |
| | A9 | 0.010 | 0.12 | 0.11 | 10.21 | 3.05 | 0.05 | | 0.022 | 0.21 | 0.03 | 0.005 |
| B | B1 | 0.015 | 0.11 | 0.07 | | | | | | | | |
| | B2 | 0.020 | 3.21 | 0.21 | 0.01 | 0.02 | | | | | | |
| | B3 | 0.082 | 2.38 | 0.58 | 13.05 | 0.01 | | | | | | |
| | B4 | 0.032 | 0.95 | 0.42 | 13.11 | 0.24 | | 0.020 | | 0.20 | | |
| C | C1 | 0.009 | 0.15 | 0.15 | 5.20 | 4.40 | | | | | | |
| | C2 | 0.010 | 0.18 | 0.17 | 15.10 | 3.75 | | | | | | |

TABLE 1-continued

| No. | Chemical Composition (Weight %) | | | | | | | | | | |
|---|---|---|---|---|---|---|---|---|---|---|---|
| | C + N | Si | Mn | Cr | Al | Ti | S | Se | Pb | Zr | Te |
| C3 | 0.009 | 0.11 | 0.14 | 10.15 | 1.25 | | | | | | |

A: Soft magnetic steel of the present invention.
B: Conventional Steel
C: Comparative Steel In Table 1, Sample Nos. A1 to A9 are soft magnetic steels of the present invention, wherein A1 to A3 are of the first, A4 is of the second, A5 to A8 are of the third, and A9 is of the fourth invention.

Sample Nos. B1 to B4 are conventional steels; wherein B1 is a pure iron, B2 is a 3% Si iron, B3 is a 13Cr-2.5Si steel, and B4 is a 13Cr-1Si-0.25Al steel. Sample No. C1 to C3 are comparative steels; wherein C1 contains Cr in an amount lower than the limit of the present invention, C2 contains Cr in an amount higher than the limit of the present invention, and C3 contains Al in an amount lower than the limit of the present invention.

The specimens shown in Table 1 were maintained at 900° C. for 2 hours, then cooled at a rate of 100° C./hr, and subjected to measurements to obtain tensile strength, limit workable percentage, (critical compressibility) electric resistance, coercive force, magnetic flux density, magnetic response, corrosion resistance, and machinability. The results are given in Table 2.

Tensile strengths were measured on a specified JIS #4 test piece. Limited workable rate was measured following the Cold Upsetting Test Method (a tentative standard) standardized by Nihon Sosei Kako Gakkai (Japan Plastic Working Society) Committee on Cold Forging, involving applying a compression test on a notched test piece of 14 mm in diameter and 21 mm in length, and measuring the fractional reduction in upsetting rate at the crack generation of 50%.

Magnetic responses were measured using a direct current type BH tracer on a 16 mm thick ring test piece with outer and inner diameters of 24 and 16 mm, respectively, to which primary and secondary coils were wound, then applying a pulse current to the primary coil, and measuring and integrating the secondary voltage to give the magnetic flux density. The time elapsed from the maximum magnetic flux density to $(1-1/c)$ x 100% (about 63%) decrease, i.e., the relaxation time, was measured. Measurement of coercive force was also performed on the same test piece.

Corrosion resistances were evaluated by salt-spraying a 5% NaCl aqueous solution at 35° C. and observing the formation of the rust. Pieces with rust generation of 5% or less were marked ◎, those with rust generation exceeding 5% but less than 25% were marked ◎, those with 25% or higher and less than 50% were marked Δ, and those with 50% or higher were marked X.

Electric resistances were measured by the Wheatstone bridge method on 12 mm diameter x 50 mm length wires.

Machinabilities were evaluated by drilling 10 mm thick test pieces using a 5 mm diameter SKH drill operating at 725 rpm, under 4 Kg load, and then measuring the time elapsed until a hole was perforated.

TABLE 2

| | No. | Cold Forgeability: Tensile Strength (kgf/mm²) | Cold Forgeability: Critical Compatibility (%) | 1* Salt Spray Test | Electric Properties: Electric Resistance (μΩ · cm) | Magnetic Properties: Coercive Force He (Oe) | Magnetic Properties: Magnetic Flux Density B20 (G) | Magnetic Properties: Magnetic Response (msec) | Machinability (sec) |
|---|---|---|---|---|---|---|---|---|---|
| A* | A1 | 43 | 65 | ◎ | 102 | 0.7 | 13,500 | 0.62 | 16.4 |
| | A2 | 42 | 66 | ◎ | 100 | 0.7 | 13,400 | 0.64 | 16.5 |
| | A3 | 42 | 64 | ◎ | 99 | 0.7 | 13,500 | 0.65 | 17.0 |
| | A4 | 40 | 67 | ◎ | 101 | 0.7 | 13,800 | 0.64 | 16.0 |
| | A5 | 42 | 62 | ○ | 100 | 0.8 | 13,200 | 0.66 | 11.5 |
| | A6 | 43 | 60 | ○ | 101 | 0.8 | 13,300 | 0.66 | 11.3 |
| | A7 | 42 | 61 | ○ | 99 | 0.8 | 13,200 | 0.67 | 7.4 |
| | A8 | 42 | 62 | ○ | 100 | 0.8 | 13,200 | 0.65 | 7.2 |
| | A9 | 43 | 62 | ○ | 102 | 0.8 | 13,500 | 0.66 | 7.0 |
| B* | B1 | 31 | 67 | X | 13 | 1.3 | 14,700 | 1.04 | 13.8 |
| | B2 | 48 | 44 | X | 62 | 1.4 | 14,300 | 0.98 | 18.2 |
| | B3 | 58 | 42 | ◎ | 91 | 2.0 | 12,100 | 0.85 | 20.2 |
| | B4 | 46 | 45 | ○ | 68 | 1.2 | 12,300 | 0.99 | 8.1 |
| C* | C1 | 40 | 67 | X | 87 | 0.7 | 13,800 | 0.88 | 16.3 |
| | C2 | 48 | 55 | ◎ | 118 | 0.7 | 13,000 | 0.59 | 17.2 |
| | C3 | 35 | 74 | ○ | 64 | 0.7 | 14,000 | 0.86 | 15.0 |

A*: Soft magnetic steel of the present invention.
B*: Conventional steel.
C*: Comparative steel.
1*: Corrosion Resistance Table 2 shows that the conventional B1 steel excels in magnetic flux density and cold forgeability, but is inferior in electric resistance, corrosion resistance, coercive force, and magnetic response. B2 steel is not so good in cold forgeability, corrosion resistance, electric resistance, coercive force, and magnetic response. B3 steel has excellent electric resistance and corrosion resistance, however, is poor in cold forgeability, coercive force, magnetic flux density, and magnetic response. B4 steel shows good corrosion resistance and machinability, but is poor in electric resistance, coercive force, magnetic flux density, magnetic response, and cold forgeability.

The comparative C1 steel contains Cr as low as 5.20% and shows good cold forgeability, but is poor in corrosion resistance, electric resistance, and magnetic response. The C2 steel with Cr as high as 15.10%, on the other hand, is improved in electric resistance, but the cold forgeability is lost. C3 steel contains Al in a small amount of 1.25% that is improved in cold forgeability, however, is inferior in the magnetic response.

In contrast to the above steels, the soft magnetic steels of A1 to A9 of the present invention give an electric resistance of 90 μΩ•cm or higher, magnetic response with a relaxation time of 0.67 msec or lower, magnetic flux density of 13000 G or higher, and coercive force of 1.0 Oe or lower, and are improved in cold forgeability as shown by the tensile strength of 44 Kgf/mm$^2$ and limited workable rate of 60% or higher, and also are improved in corrosion resistance and machinability.

Applicability in Industrial Field

The soft magnetic steel of the present invention, as explained above, possesses excellent cold forgeability, electric properties, magnetic properties, and corrosion resistance, by combined addition of appropriate amounts of Cr and Al, together with extremely low controlled solid-solution strengthening elements such as Si, Mn, C, and N. Further, machinability is improved without affecting cold forgeability, with combined addition of elements chosen from S, Se, Pb, Te and Zr and Ti, according to the requirements.

The soft magnetic steel of the present invention is highly practical, fit for magnetic core parts of pulse-operating electronic fuel injection systems, solenoid valves, electromagnetic sensors, etc., which are manufactured by cold forging.

What is claimed is:

1. A soft magnetic steel consisting by weight, of 0.015% or lower C+N, 0.20% or lower Si, 0.20% or lower Mn, 7 to 13% Cr, 2 to 5% Al, and balance of Fe with impurities having a tensile strength of 44 Kgf/mm$^2$ or lower, a limiting workability of 60% or higher, a coercive force of 0.7 Oe or lower, a magnetic flux density of 13,000 G or higher, a magnetic response with relaxation time of 0.7 msec or shorter, and an electric resistance of 90 μΩ•cm or higher.

2. A soft magnetic steel consisting by weight, of 0.015% or lower C+N, 0.20% or lower Si, 0.20% or lower Mn, 7 to 13% Cr, 2 to 5% Al, 0.08% or lower Ti, and balance of Fe with impurities having a tensile strength of 44 Kgf/mm$^2$ or lower, a limiting workability of 60% or higher, a coercive force of 0.7 Oe or lower, a magnetic flux density of 13,000 G or higher, a magnetic response with relaxation time of 0.7 msec or shorter, and an electric resistance of 90 μΩ•cm or higher.

3. A soft magnetic steel consisting by weight, of 0.015% or lower C+N, 0.20% or lower Si, 0.20% or lower Mn, 7 to 13% Cr, 2 to 5% Al, at least one of the ingredients selected from 0.050% or lower S, 0.050% or lower Se, and 0.030% or lower Pb; together with 0.20% or lower Zr and/or 0.030% or lower Te, and balance of Fe with impurities having a tensile strength of 44 Kgf/mm$^2$ or lower, a limiting workability of 60% or higher, a coercive force of 0.7 Oe or lower, a magnetic flux density of 13,000 G or higher, a magnetic response with relaxation time of 0.7 msec or shorter, and an electric resistance of 90 μΩ•cm or higher.

4. A soft magnetic steel consisting by weight, of 0.015% or lower C+N, 0.20% or lower Si, 0.20% or lower Mn, 7 to 13% Cr, 2 to 5% Al, 0.08% or lower Ti, at least one of the ingredients selected from 0.050% or lower S, 0.050% or lower Se, and 0.030% or lower Pb; together with 0.20% or lower Zr and/or 0.030% or lower Te, and the balance of Fe with impurities having a tensile strength of 44 Kbf/mm$^2$ or lower, a limiting workability of 60% or higher, a coercive force of 0.7 Oe or lower, a magnetic flux density of 13,000 G or higher, a magnetic response with relaxation time of 0.7 msec or shorter, and an electric resistance of 90 μΩ•cm or higher.

* * * * *